United States Patent [19]

Bühler et al.

[11] 4,433,220

[45] Feb. 21, 1984

[54] HIGH-VOLTAGE CIRCUIT BREAKER

[75] Inventors: Anton Bühler, Triengen; Peter Hug, Safenwil, both of Switzerland

[73] Assignee: Sprecher & Schuh AG, Aarau, Switzerland

[21] Appl. No.: 358,217

[22] Filed: Mar. 15, 1982

[30] Foreign Application Priority Data

Apr. 22, 1981 [CH] Switzerland ..... 2618/81

[51] Int. Cl.[3] ..... H01H 33/16

[52] U.S. Cl. ..... 200/144 AP; 200/148 D; 200/148 F; 200/153 LB

[58] Field of Search ..... 200/144 AP, 148 F, 153 LB, 200/153 L, 148 D

[56] References Cited

U.S. PATENT DOCUMENTS 3,676,621 7/1972 Pflanz ..... 200/144 AP 3,763,340 10/1973 Noack ..... 200/148 D

*Primary Examiner*—Robert S. Macon

*Attorney, Agent, or Firm*—Werner W. Kleeman

[57] ABSTRACT

At least one primary switch position is connected in parallel with a series circuit composed of an auxiliary switch position provided with a cut-on or switching-in resistor. By means of a respective one of two lever drives each switch position is operatively coupled with a drive rod movable between a cut-on position and a cut-off position. The lever drive correlated to the primary switch position is provided with a double-arm lever which is pivotable about a stationary shaft. The double-arm lever is coupled at its one end to the drive rod and at its other end is coupled to a movable switching element of the primary switch position. The lever drive correlated to the auxiliary switch position is constructed such that during a cut-on stroke the auxiliary switch position initially is closed and at the end of the cut-on stroke such is reopened. In order to obtain these switching characteristics of the lever drive correlated to the auxiliary switch position with the smallest possible expenditure, in equipment design of the circuit breaker, without play-afflicted connections to the drive rod and without the need to use a spring-force storage, this lever drive possesses a pivot arm which is driven by the rotatably mounted shaft supporting the double-arm lever. Hinged to the end of this pivot arm is a cam disc which can be pivoted between two stable positions about a pivot or tilt shaft extending essentially parallel to the aforesaid rotatably mounted shaft. The cam disc is provided with a cam track into which engages a cam follower element secured to the movable switching element of the auxiliary switch position.

8 Claims, 6 Drawing Figures

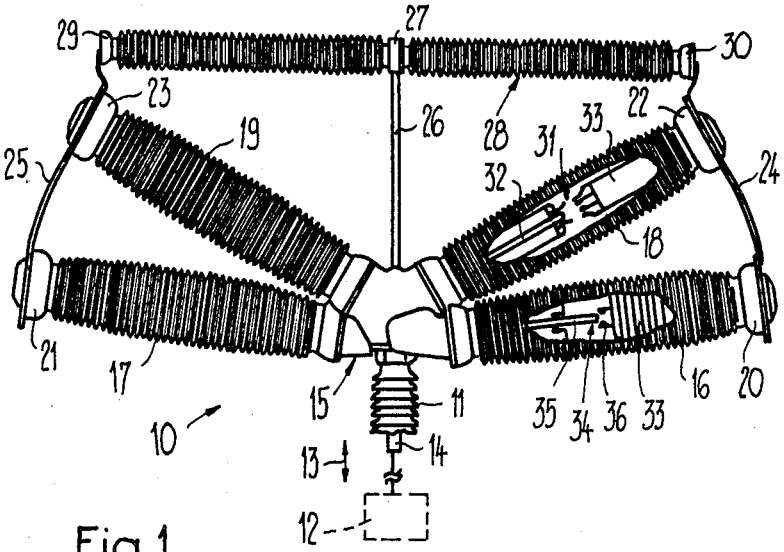
Fig.1
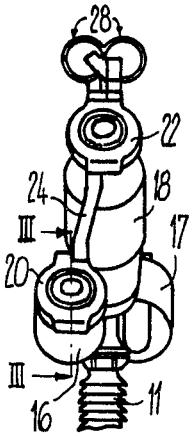
Fig.2
Fig.3
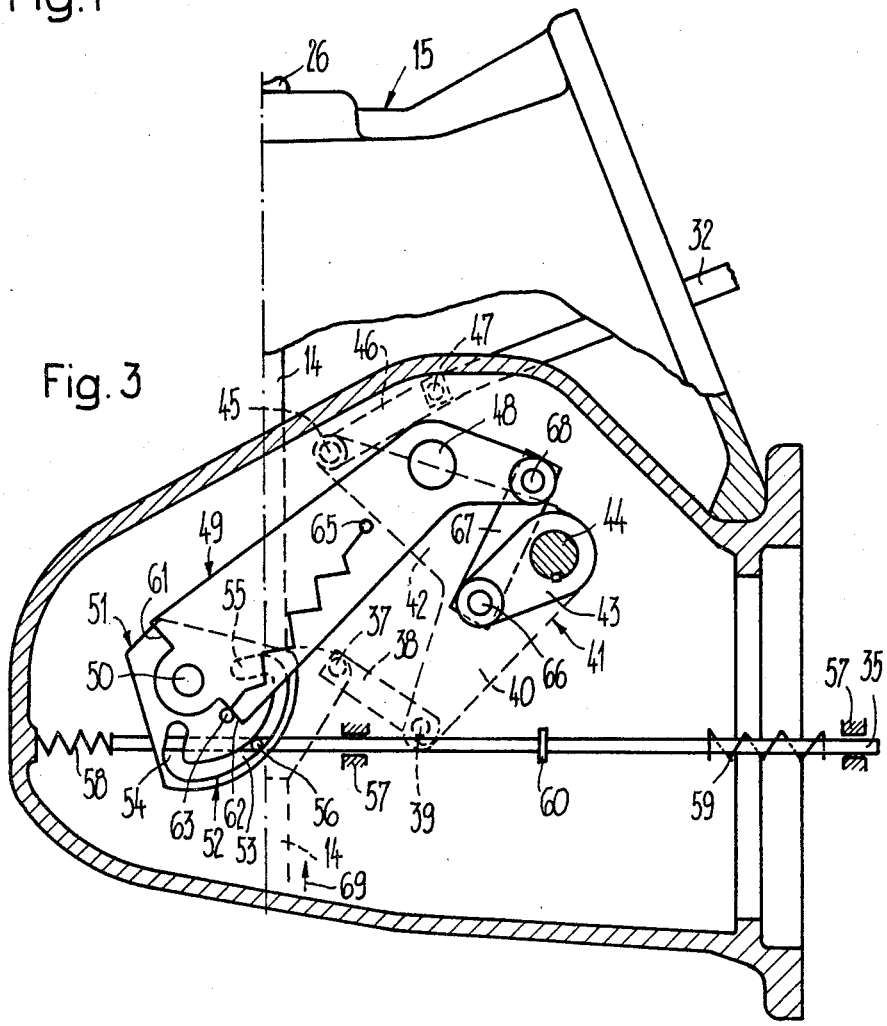

HIGH-VOLTAGE CIRCUIT BREAKER

BACKGROUND OF THE INVENTION

The present invention relates to a new and improved construction of a high-voltage circuit breaker or switch.

Generally speaking, the high-voltage circuit breaker or switch of the present development is of the type comprising at least one primary switch position with which there is connected in parallel a series circuit of an auxiliary switch position provided with a cut-on or switching-in resistor, Both switch positions are operatively coupled, by means of a respective lever drive, with a drive rod which is movable between a cut-on position and a cut-off position. As to these lever drives the lever drive operatively correlated to the primary switch position contains a double-arm lever which is pivotable about a stationarily arranged shaft. One end of this double-arm lever is coupled with the drive rod and the other end of such double-arm lever is coupled with the movable switching element of the primary switching location. The lever drive operatively correlated with the auxiliary switch position is structured such that during a cut-on stroke there is initially closed the auxiliary switch position and such again opens at the end of such cut-on stroke.

With high-voltage circuit breakers or switches, wherein a series circuit of an auxiliary switch position equipped with a cut-on resistor is connected in parallel with the primary switch position, the auxiliary switch position, during a cut-on stroke, closes before the primary switch position for the purpose of switching-in the cut-on resistor. With high-voltage circuit breakers or switches of this type, two species or classifications of such circuit breakers are to be distinguished from one another. With the first species the auxiliary switch position is reopened shortly after the primary switch position has been closed, i.e. at the end of the cut-on stroke. With the second species the auxiliary switch position remains closed even when the primary switch position is closed, and measures are taken which, during a cut-off stroke, cause the auxiliary switch position to open before the primary switch position. The high-voltage circuit breaker or switch disclosed according to the present invention belongs to the first species or class described above.

With a prior art high-voltage circuit breaker or switch of this type, as known to the art from German Pat. No. 2,108,915 and the corresponding U.S. Pat. No. 3,763,340, granted Oct. 2, 1973, the course of the movements accompanying the cut-on stroke and characteristic for the here discussed species of circuit breaker, are obtained by facilities which are complicated and, therefore, in practice, have proven not to be very functionally reliable. With this prior art high-voltage circuit breaker or switch the movable switching element of the auxiliary switch position is operatively associated with a spring-force storage which must be tensioned during a cut-on stroke. This initially requires a higher drive output or power. The spring-force storage is blocked by means of a locking element until there has been reached the cut-on position of the primary switch position. Upon reaching the cut-on position the locking element is displaced and the spring-force storage is released, whereby there is retracted the switching element of the auxiliary switch position. During the course of the cut-off stroke the locking element, which is exposed to the action of a spring, again assumes its blocking or locking position. If, with this prior art high-voltage circuit breaker, the locking element should become jammed for any possible reason, whether it be in the blocking position or in the release position, then there is no longer guaranteed for the desired mode of operation of the circuit breaker.

With a further high-voltage circuit breaker or switch of the initially mentioned type and not belonging to the present state of the art, it has been proposed, by specially designing the lever drive correlated to the movable switching element of the auxiliary switch position, to construct an arm of an angle lever leading to the drive rod as one of the two members of a toggle lever which can be pressed-over and whose other member is hinged to the drive rod. In the case of a toggle lever which can be pressed-over one of the members of the toggle lever, which member is hinged to a respective one of the three hinges of the toggle lever, necessarily must be displaceable thereat in a translatory fashion with respect to the corresponding pivot bolt, for instance by means of a longitudinal slot or hole. As a result, there does not exist a coupling which is free of play between the drive rod and the movable switching element of the auxiliary switch position and, consequently, the lever drive is exposed to considerable shocks which occur during a switching operation.

SUMMARY OF THE INVENTION

Therefore, with the foregoing in mind it is a primary object of the present invention to provide a new and improved construction of high-voltage circuit breaker of the initially mentioned type which is not afflicted with the aforementioned drawbacks and limitations of the heretofore discussed proposals.

Another and more specific object of the present invention aims at the provision of a new and improved construction of high-voltage circuit breaker which, even with the use of the most simple means and with a very compact construction, ensures for a coupling between the movable switching element and the drive rod which at all times is free of play and without having to use a spring-force storage.

Yet a further significant object of the present invention is directed to a new and improved construction of high-voltage circuit breaker which does not require a spring-force storage.

Still a further important object of the present invention aims a the provision of a new and improved construction of high-voltage circuit breaker which is relatively simple in construction and design, extremely economical to manufacture, highly reliable in operation, not readily subject to breakdown or malfunction, and requires a minimum of maintenance and servicing.

Now in order to implement these and still further objects of the invention, which will become more readily apparent as the description proceeds, the high-voltage circuit breaker or switch of the present development is manifested by the features that, the drive which is operatively associated with the auxiliary switch position is provided with a pivot arm which is driven by means of the double-arm lever. At the free end of this pivot arm there is hinged a cam disc or the like which can be pivoted or tilted between two stable positions about a pivot or tilt shaft arranged essentially in parallel with the stationary shaft. The cam disc is provided with a cam track with which engages a follower element or cam follower which is secured to the movable switching element of the auxiliary switch position.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 illustrates, with cut-away parts, a simplified side view of a high-voltage circuit breaker or switch containing two primary switch positions, each of which has operatively associated therewith a respective auxiliary switch position provided with a cut-on resistor;

FIG. 2 is a side view of the high-voltage circuit breaker according to FIG. 1, but viewed from a direction turned 90° with respect to the showing of FIG. 1;

FIG. 3 is a schematic sectional view essentially taken along the line III—III of FIG. 2, wherein the lever drive operatively associated with the primary switch position is illustrated by means of broken or phantom lines, whereas the lever drive which is operatively associated with the auxiliary switch position is illustrated in greater detail.

DETAILED DESCRIPTION OF THE PREFERRED EMBODIMENTS

Figure 4:
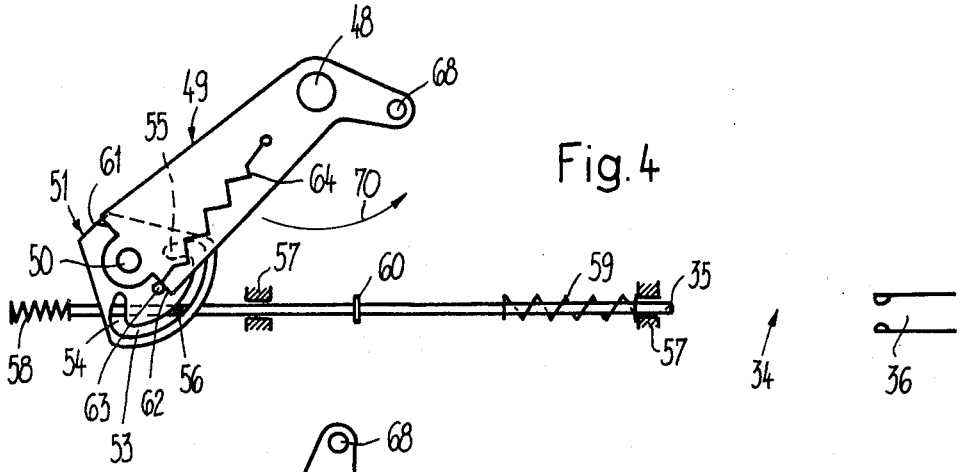
FIGS. 4–6 are respective illustrations similar to the showing of FIG. 3, but depicting on a smaller scale, in three different movement phases, the essential parts or components of the lever drive which is operatively associated with the auxiliary switch position.
Figure 5:
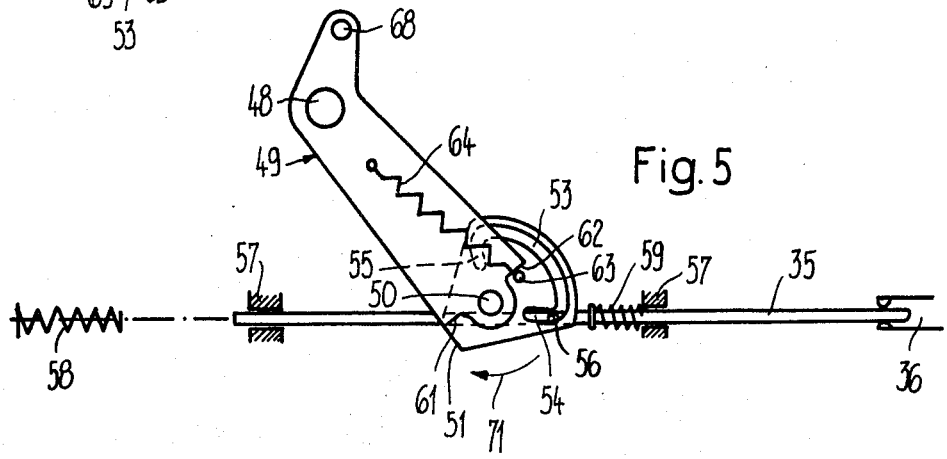

Describing now the drawings, the high-voltage circuit breaker or switch 10 illustrated by way of example in FIG. 1 contains a substantially tubular-shaped support insulator 11, wherein only the upper part has been illustrated in the drawing. Depending upon the voltage of the high-voltage circuit breaker 10, the support insulator 11 can be several meters high and at its lower end is connected to a merely schematically indicated conventional drive unit 12. From this drive unit 12 there extends a drive rod 14 which passes through the support insulator 11 and can be moved to-and-fro in the direction of the double-headed arrow 13. Flanged to the upper end of the support insulator 11 is a metallic drive or transmission housing 15. At both sides of the drive housing 15 there are connected therewith two substantially tubular-shaped insulators 16, 18 and 17, 19, respectively, which are closed by connection caps 20, 22 and 12, 13, respectively, or equivalent structure. The connection cap 20, to which there can be connected a here not illustrated connection conductor or line for the circuit breaker 10, is electrically connected with the connection cap 22 by means of a conductor or line 24. The connection cap 21, to which there can be connected the other connection conductor or line for the circuit breaker 10, is electrically connected with the connection cap 23 by means of a conductor or line 25. Extending from the drive housing 15 is a metallic support strut or brace 26 which is electrically connected therewith and with the center connection 27 of a capacitive voltage divider 28 and supports this voltage divider 28 at such center connection 27. The end connections 30 and 29 of the voltage divider 28 are electrically connected with the connection caps 22 and 23, respectively.

Each of the substantially tubular-shaped support insulators 18 and 19 encloses a respective primary switch position 31 provided with a movable switching element 32 and a stationary switching element 33 which is secured at the inside of the related connection cap 22 and 23, respectively, as has been schematically illustrated for the insulator 18 shown in FIG. 1. Each of the substantially tubular-shaped insulators 16 and 17, on the other hand, encloses a respective series circuit of a cut-on or switching-in resistor 33 and an auxiliary switch position 34 which, in turn, is provided with a movable switching element 35 and a stationary switching element 36. This stationary switching element 36 is mounted at one end of the cut-on resistor 33, while the other end of the cut-on resistor 33 is secured to the inside of the connection cap 20. Analogously, the same holds true for the other auxiliary switch position provided in the insulator 17.

With respect to FIG. 3 there now will be explained the mechanical coupling between the drive rod 14, on the one hand, and the movable switching elements 32 and 35, on the other hand, and specifically for the switch positions 31 and 34 arranged in the insulators 18 and 16, respectively. As to the corresponding switch positions in the insulators 19 and 17 the elements provided for mechanically coupling these switch positions to the drive rod 14 can be arranged and constructed in a mirror-image fashion with respect to the elements illustrated in FIG. 3. As will be understood and apparent from the drawings, FIG. 3 illustrates the cut-off position.

To the upper end of the drive rod 14 there is pivotably connected or hinged, at location 37, the one end of a coupling element or link 38, the other end of which is pivotably connected, at location 39, with the free end of an arm or arm member 40 of an angle lever 41. This angle lever 41 is rigidly mounted for rotation upon a shaft 44, which is stationarily arranged, yet rotatably mounted in the housing 15. At the free end of the other arm 42 of the angle lever 41 there is pivotably connected, at location 45, the one end of a coupling element or link 46, the other end of which is pivotably connected or hinged, at location 47, to the switching element 32, which is guided to be displaceable in an essentially linear longitudinal direction in any suitable guides.

Furthermore, there is keyed or otherwise appropriately affixed to the rotatable shaft 44 a crank 43 which is arranged to be axially offset with respect to the angle lever 41 and, accordingly, performs the same pivoting movements as the angle lever 41. By means of a pivot pin 66 there is pivotably connected to the free end of crank 43 the one end of a bracket 67, to the other end of which there is pivotably connected, at location 68, the one end of a pivot arm 49. This pivot arm 49 is configured substantially like an angle lever and, in turn, is seated or rotatably mounted upon a pin or pivot pin member 48 which is arranged essentially parallel to the rotatable shaft 44. At the other end of the pivot arm 49 there is pivotably connected a cam disc or cam means 51 by means of a pivot shaft 50 which is arranged essentially parallel to the rotatable shaft 44 and the pivot pin 48. This cam disc 51 or equivalent structure is provided with a cam track or groove 52, for instance in the form of an open or pass-through slot which possesses a central or intermediate arcuate-shaped portion or section 53 extending essentially concentrically with respect to the pivot shaft 50 and through a spanning angle of about 90°, and two essentially linear end sections or portions 54 and 55 which are directed towards the pivot shaft 50. Engaging with this cam track 52 is a suitable follower element or cam follower 56, for instance in the form of a pin, which is secured to the movable switching element 35 operatively correlated to the auxiliary switching path and which switching element 35 is constructed as a contact pin. The switching element 35 is guided to be longitudinally displaceable in here merely schematically indicated guides 57 and, at its end facing away or remote from the stationary switching element 36 (the left-hand side of FIG. 3), cooperates with a buffer spring 58 or the like, which is supported in the interior of the housing 15. A further buffer spring 59 is wound around the switching element 35, and specifically, between the guide 57 depicted at the right-hand side of FIG. 3 and a stop or impact collar 60 secured to the switching element 35. This buffer spring 59 is loosely or freely displaceable in this position of the circuit breaker or switch.

Figure 6:
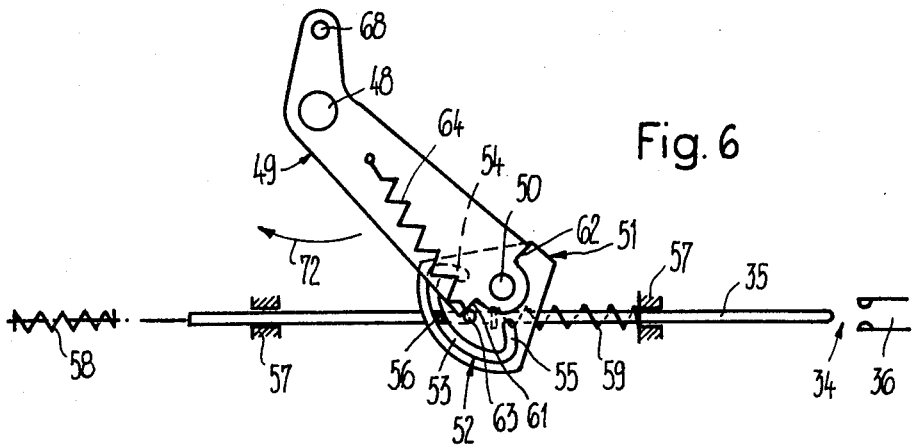

At the end of the pivot arm or pivotable arm member 49 carrying the cam disc or cam means 51 there is arranged to both sides of the pivot shaft 50 a respective one of two impact shoulders or surfaces 61 and 62 which cooperate with an impact pin or member 63 anchored at the cam disc 51 itself. At this impact pin 63 or equivalent structure there is suspended one end of a tension spring 64, the other end of which is suspended at the pivot arm 49 itself, for instance in a bore or hole 65 arranged along a connection line extending between the pivot pin 48 and the pivot shaft 50 or at a suspension pin arranged at such pivot arm 49. Thus, the cam disc 51 can assume either of two stable positions with respect to the pivot arm or pivotable arm member 49, wherein one of these stable positions has been illustrated in FIG. 3 in the cut-off position of the circuit breaker and the other stable position is shifted with respect to the former in the clockwise direction through an angle of 180°. In this other position the impact pin 63 bears against the shoulder 61, as best seen by referring to FIG. 6.

With respect to the illustration of FIGS. 3 to 6 there now will be described the course of the movements occurring during the switching strokes or operations.

Initially looking at FIGS. 3 and 4 (the cut-off position), during a cut-on stroke the drive rod 14 is upwardly displaced in the direction of the arrow 69. Consequently, the angle lever or lever member 41 and together therewith the crank 43 are pivoted in the clockwise direction and the movable switching element 32 of the primary switch position is forwardly advanced towards the upper side of the showing of FIG. 3. On the other hand, the pivot arm or pivotable arm member 49 is pivoted in the counter-clockwise sense, according to the direction of the arrow 70 in FIG. 4, because of its angle lever-shaped configuration. Initially, the cam disc 51 which bears by means of the impact pin 63 against the impact shoulder 62 can only describe a circular or arcuate-shaped path about the pivot pin 48, whereas the cam follower element or cam follower 56 can only move in an essentially linear direction because of the guides 57. Thus, the movable switching element 35 operatively correlated to the auxiliary switch position 34 is initially displaced to the right towards the stationary switching element 36, according to the showing of FIG. 4. The cam follower element 56 located in the curved intermediate cam section 53 of the can track 52 initially migrates towards the cam end or terminal section 55. When the part of the pivot arm or pivotable arm member 49 carrying the cam disc 51, during the course of the pivoting movement, has reached a position which is substantially perpendicular with respect to the direction of movement of the switching element 35, the cam follower element 56 located in the cam section 53 of the cam track 52 is positioned closest to the cam end section 55. With the continuation of the pivoting movement the follower element 56 located in the cam section 53 then migrates in the direction towards the other cam end or terminal section 54 until reaching the position illustrated in FIG. 5. During all movement phases occurring between the position of the parts shown in FIGS. 4 and 5 the movable switching element 35 has been forwardly advanced in the direction towards the stationary switching element 36 and has come into engagement therewith shortly prior to reaching the position illustrated in FIG. 5. Simultaneously, the impact or stop collar 60 has impacted against the buffer spring 59 and has compressed the same. This buffer spring 59 now exerts a force, acting opposite to the cut-on direction, upon the switching element 35 and, thus, also upon the cam follower element 56. Consequently, the follower element 56 now enters the cam end section 54 of the cam track 52, and thus the switching element 35, in turn, performs a first step towards the cut-off position. Consequently, the follower element 56 causes the cam disc or cam means 51 to pivot in the clockwise sense about the pivot or tilt shaft 50, according to the direction of the arrow 71 in FIG. 5. As soon as during the course of such pivoting movement of the cam disc 51 the tension spring 64 crosses the connection line between the center of the pivot pin 48 and the center of the pivot shaft 50, then the cam disc 51 pivots further in the clockwise sense until the impact or stop pin 63 impacts against the impact shoulder 61 (compare FIG. 6). The pivoting movement of the cam disc 51 is accompanied by a further movement of the switching element 35 towards the cut-off position, so that at the end of the cut-on stroke (FIG. 6) the auxiliary switch position 34 has been reopened.

During the cut-off stroke the angle lever or angle lever member 41 is pivoted in the counter-clockwise sense by virtue of the downward movement of the drive rod 14, so that the movable switching element 32 of the primary switch position disengages from the switching element 33. At the same time the pivot arm 49 is pivoted in the clockwise sense, according to the arrow 72 of FIG. 6, so that the switching element 35 is initially further withdrawn from the switching element 36 by the action of the follower element 56 and the cam track 52. Shortly before the end of the cut-off stroke, the follower element or cam follower 56, which has entered the cam end section 55, and the action of the compressed buffer spring 58, force the cam disc 51 to pivot back into the position illustrated in FIG. 4, whereby the switching element 35 again performs a first, small movement towards the switching element 36.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A high-voltage circuit breaker comprising:

means defining at least one primary switch position;

means defining a series circuit of an auxiliary switch position containing a cut-on resistor;

said primary switch position being connected in parallel with said series circuit of said auxiliary switch position and said cut-on resistor;

a drive rod displaceable between a cut-on position and a cut-off position;

means for driving said drive rod;

a respective lever drive means operatively connected with a related one of said switch positions and operatively coupling each said switch position with said drive rod;

said lever drive means of said primary switch position containing a double-arm lever;

a stationarily arranged and rotatably mounted shaft about which there is pivotably mounted said double-arm lever;

said double-arm lever having a first end and a second end;

said primary switch position having a movable switching element;

said first end of said double-arm lever being coupled with said drive rod and said second end with said movable switch element of said primary switch position;

said lever drive means of said auxiliary switch position being structured such that during a cut-on stroke there is initially closed said auxiliary switch position and such again opened at the end of said cut-on stroke;

said lever drive means of said auxiliary switch position comprising a pivotable arm member driven by said double-arm lever;

said pivotable arm member having a free end;

cam means;

pivot shaft means for mounting said cam means at said free end of said pivotable arm member so as to be movable between two stable positions about said pivot shaft means which extends essentially parallel to said rotatably mounted shaft;

said cam means having a cam track; and said auxiliary switch position containing a movable switching element carrying a cam follower engageable with said cam track.

2. The high-voltage circuit breaker as defined in claim 1, further including:

pivot pin means extending essentially parallel to said rotatably mounted shaft;

said pivotable arm member being seated upon said pivot pin means; and said double-arm lever being rigidly connected for rotation with said rotatably mounted shaft.

3. The high-voltage circuit breaker as defined in claim 1, wherein:

said cam track possesses an essentially arcuate-shaped cam track portion extending substantially concentrically about said pivot shaft means of said cam means; and said arcuate-shaped cam track portion having end regions at which merges a respective substantially linear end portion directed substantially radially towards said pivot shaft means of said cam means.

4. The high-voltage circuit breaker as defined in claim 1, wherein:

said cam track comprises a cam disk defining said cam means and having a pass-through slot for receiving said cam follower.

5. The high-voltage circuit breaker as defined in claim 1, wherein:

said free end of said pivotable arm member is provided with impact shoulders located essentially at the height of and to both sides of the pivot shaft means of the cam means; and an impact pin provided for said cam means with which cooperate said impact shoulders, in order to thereby determine two stable positions of said cam means.

6. The high-voltage circuit breaker as defined in claim 5, further including:

a tension spring having opposed ends;

one end of said tension spring being suspended at said pivotable arm member;

the other end of said tension spring being suspended at said impact pin; and a connection line extending between suspension points of said tension spring intersecting said pivot shaft means of said cam means during the course of the pivoting movement of said cam means.

7. The high-voltage circuit breaker as defined in claim 3, wherein:

said arcuate-shaped cam track portion of said cam means possesses a spanning angle of about 90°; and said cam means being tiltable in relation to said pivotable arm member through an angle of about 180°.

8. The high-voltage circuit breaker as defined in claim 1, wherein:

said cam means comprises a cam disk.

* * * * *